US005601442A

United States Patent [19]

Harting et al.

[11] Patent Number: 5,601,442

[45] Date of Patent: Feb. 11, 1997

[54] SWITCH PLUG

[75] Inventors: Dietmar Harting, Espelkamp; Gunter Pape, Bielefeld; Doris Wichering, Osnabruck, all of Germany

[73] Assignee: Harting Elektronik GmbH, Germany

[21] Appl. No.: 573,138

[22] Filed: Dec. 15, 1995

[30] Foreign Application Priority Data

Sep. 27, 1995 [DE] Germany ..... 195 35 913.5

[51] Int. Cl.[6] ..... H01R 13/703

[52] U.S. Cl. ..... 439/188; 200/51.1

[58] Field of Search ..... 439/188, 189, 439/513, 43; 200/51.1

[56] References Cited

U.S. PATENT DOCUMENTS 4,725,241 2/1988 Bertini et al. ..... 439/188

5,071,362 12/1991 Martens et al. ..... 439/188

5,259,776 11/1993 Giroux ..... 439/188

5,273,448 12/1993 Myer et al. ..... 439/188

5,277,606 1/1994 Giroux et al. ..... 439/188

*Primary Examiner*—Neil Abrams

*Attorney, Agent, or Firm*—Dorn, McEachran, Jambor & Keating

[57] ABSTRACT

For a switch plug with contact springs arranged in contact chambers of an insulating body, wherein at least two adjacent contact springs are connected by means of a jumper when no mating plug is plugged in, it is proposed, with a view to clearing the short circuit upon introduction of the blade contacts of a mating plug, to provide an actuating component made of plastic material in the entry zone of the blade contracts which acts upon a spring elastic jumper in such a way that the connection between the contact springs is broken.

13 Claims, 5 Drawing Sheets

SWITCH PLUG

THE FIELD OF THE INVENTION

The invention relates to a switch plug with contact springs arranged in contact chambers of an insulating body, wherein contact blades of a corresponding mating plug are capable of being introduced into the contact chambers and thereby come into contact with the contact springs and in which at least one jumper is provided which short circuits two adjacent contact springs when no mating plug is plugged in and wherein the short circuit is cleared when the blade contacts are introduced into the contact chambers.

Such switch plugs are used in electronic systems in which, when a plug connection is disconnected, selected contacts or contact elements of one plug connector, namely of the switch plug, are not permitted to terminate as "open" contacts (signaling lines) but have to be connected to one another.

A switch plug of this type is shown in U.S. Pat. No. 5,259,776. In this case U-shaped jumpers are arranged between adjacent contact springs, with non-conducting plastic parts being fastened to the legs of said jumpers. When contact blades are introduced into the switch plug said contact blades act on the plastic parts of the jumpers in such a way that the jumpers are removed from the contact springs. In the case of the known switch plug the insulating body is constructed in two parts, consisting of a base part and a cover part, in order that the jumpers can be inserted into corresponding sockets in the base part. Owing to the small dimensions of the plastic parts necessitated by the design, clearing of the short circuit is not always guaranteed if the mating plug, i.e., the contact blades thereof, is not plugged into the switch plug in a precisely centric and perpendicular manner.

Furthermore, the smaller air gap and creep distance remaining between conductive parts in the event of contact blades being introduced in slanting manner often do not meet the requirements.

SUMMARY OF THE INVENTION

The object underlying the invention is to construct a switch plug of the type specified in the introduction to the effect that a one-piece insulating body can be used and the operational reliability of the switch plug is enhanced.

This object is achieved in that the jumper made of spring elastic, conductive material is inserted into a recess between two contact chambers, whereby lateral contact arms of the jumper protrude into the contact chambers and bear resiliently against the contact legs of the contact spring, and in that in the entry zone of the contact chambers an elastic actuating component made of plastic material is provided which, upon introduction of a contact blade, acts on the jumper in such a way that the contact arms thereof are pushed away from the contact legs of the spring contacts and the short circuit is cleared.

The advantages achieved with the invention consist in particular in that, by virtue of the separately provided actuating component and the arrangement thereof, also in the case where contact blades of the mating plug have been introduced obliquely, on the one hand a reliable clearing of the short circuit between two contact spring ends of the switch plug is achieved and, on the other hand, in the process the creep distance and air gap between conductive parts of the plug connection that are necessary for the application are also always guaranteed, so that the operational reliability overall is enhanced.

A further advantage is that the insulating body of the switch plug can be constructed in one piece and in that by way of mating plug use can be made of an unmodified blade-type plug connector such as is also already known and used for plug connections without switch elements. Furthermore, an additional advantage of the switch plug according to the invention is that the contact elements used are double contact springs which are known as such and which are also already available from stock for other applications or plug connectors, and the contact spring which make contact on one side can be produced by simple removal of one spring leg of a double contact spring.

BRIEF DESCRIPTION OF THE DRAWINGS

The invention is illustrated diagrammatically in the following drawings wherein.

DESCRIPTION OF THE PREFERRED EMBODIMENT

Figure 1:
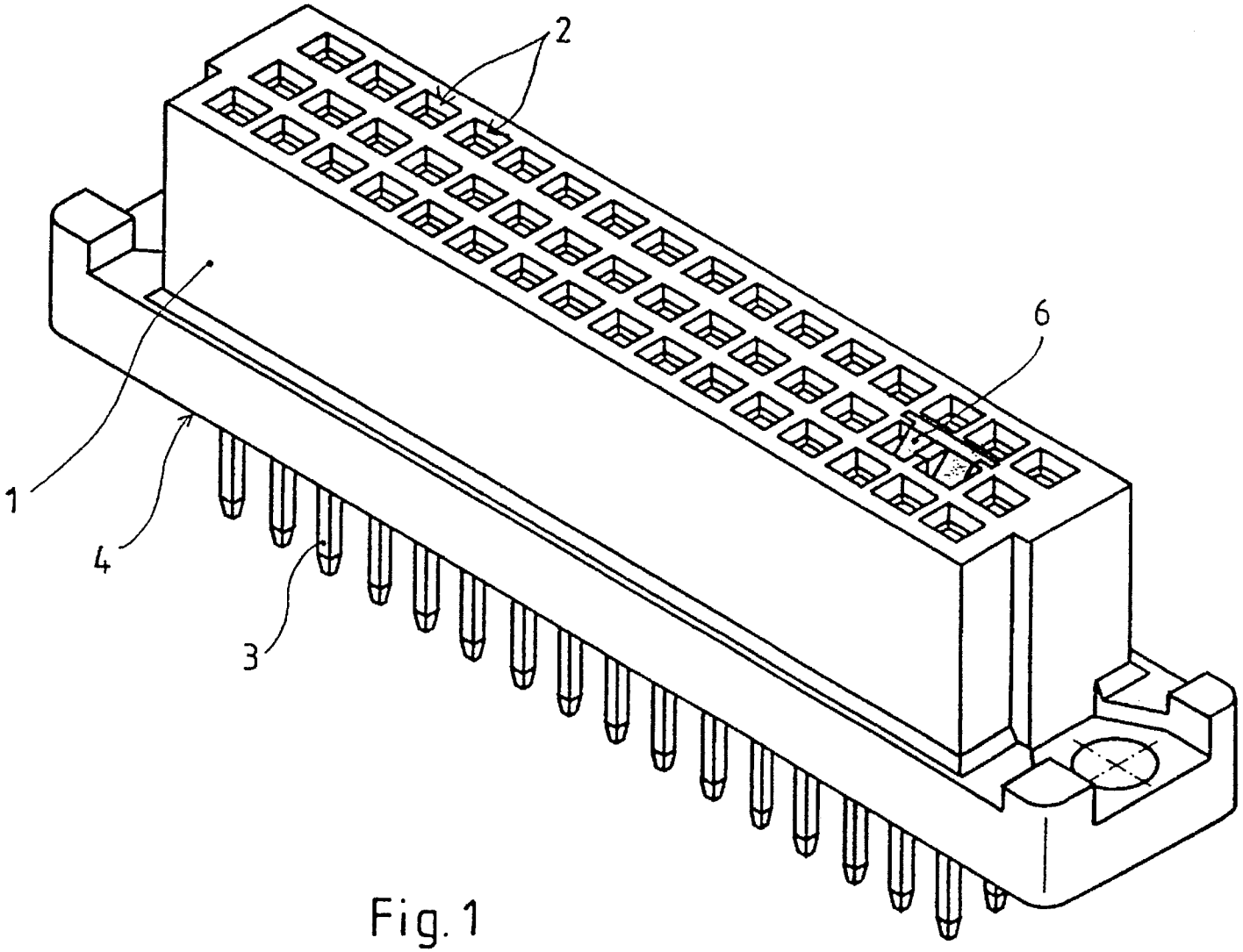
FIG. 1 is a perspective view of a switch plug of the present invention.

The switch plug shown in FIG. 1 consists essentially of an insulating body 1 provided with contact chambers 2, into which contact elements 3 are inserted from the underside 4 and anchored, with the contact elements taking the form of spring contacts.

The contact elements are arranged in rows and columns, and the mechanical design or plug-in geometry of the switch plug is such that a corresponding mating plug with blade contacts is capable of being plugged into it. The plug-in geometry is designed overall to conform to standard commercial DIN plug connectors. Between two adjacent contact chambers a jumper is inserted which, in the case where no blade contacts have been introduced, short circuits the spring contacts of said chambers and which upon introduction of the blade contacts is removed from the spring contacts so that the short circuit is cleared.

Figure 2:
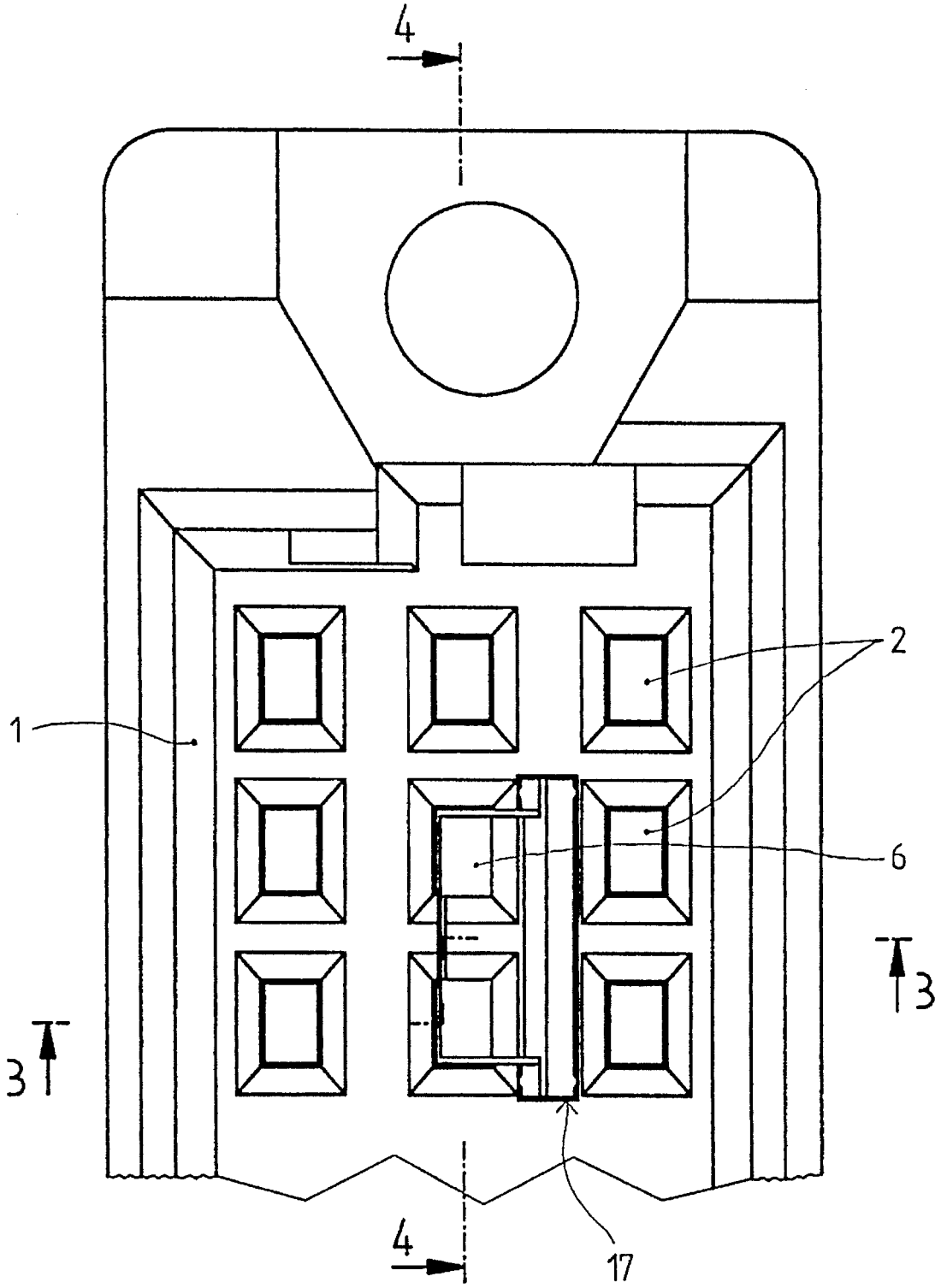
FIG. 2 is a enlarged top view of a portion of the switch plug.
Figure 3:
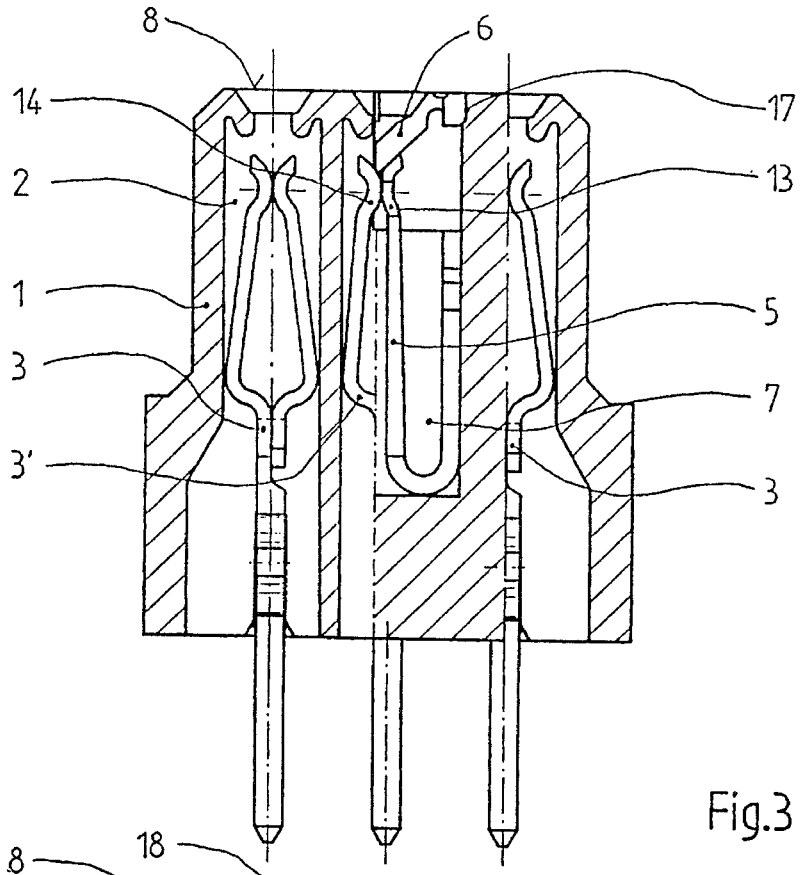
FIG. 3 is a sectional view of the switch plug according to FIG. 2 along 3—3.
Figure 3A:
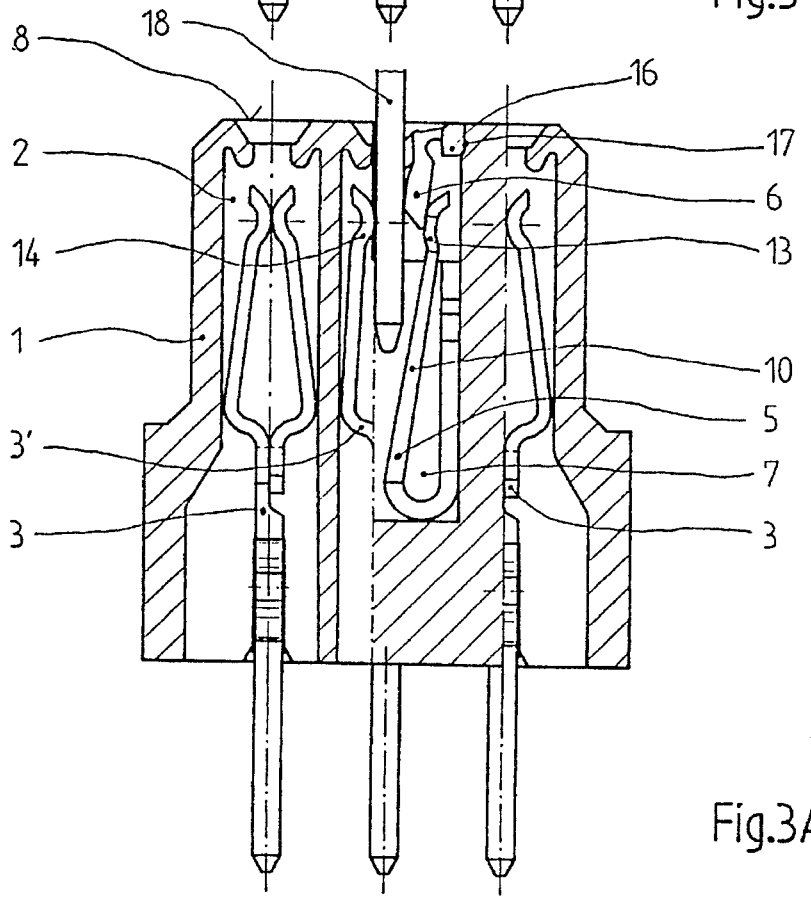
FIG. 3A is a sectional view of the switch plug according to FIG. 2 along line 3—3 with blade contact inserted.
Figure 4:
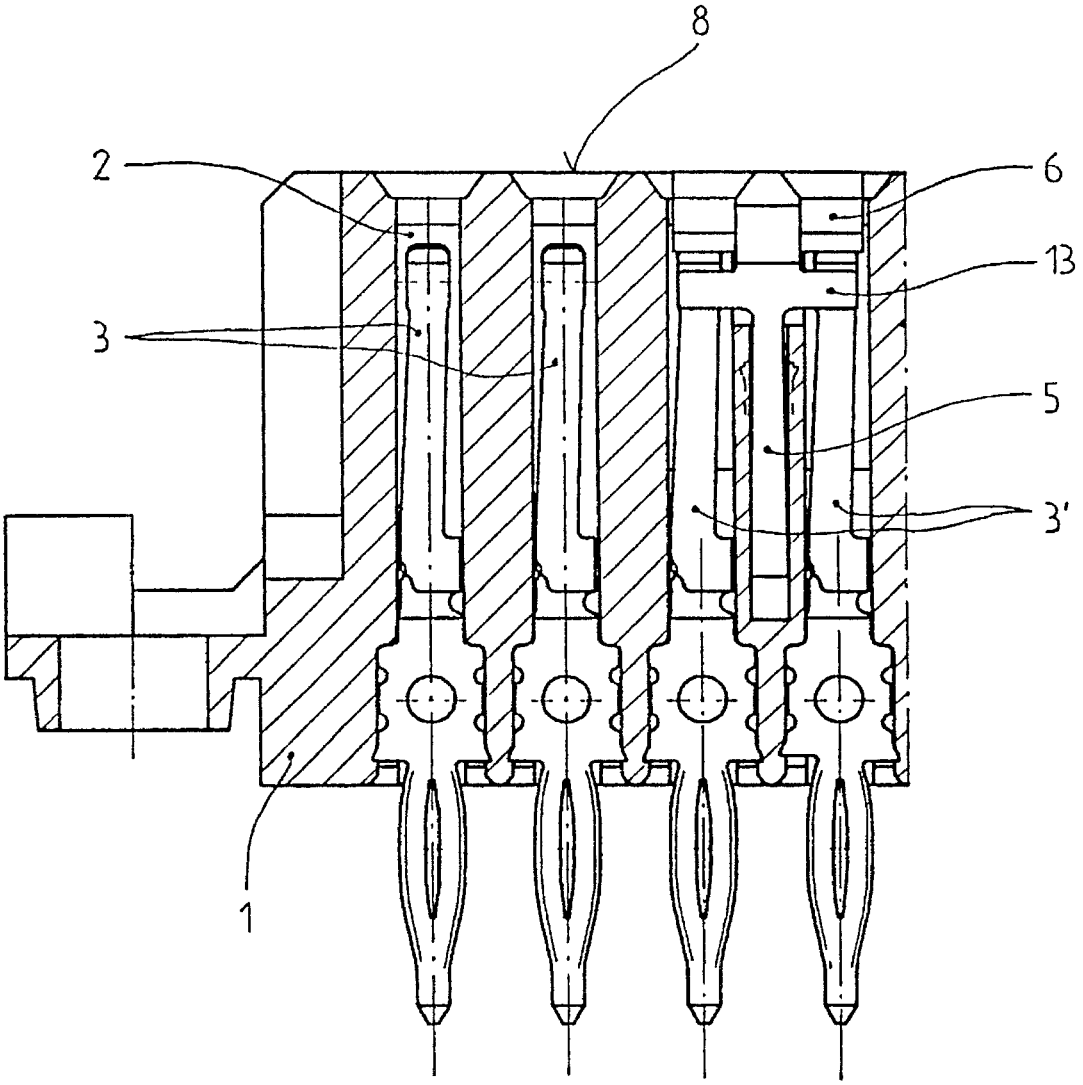
FIG. 4 is a sectional view of the switch plug according to FIG. 2 along line 4—4.

FIG. 2 shows an enlarged top view of a part of the switch plug in order to make details clear, and the sectional views of FIGS. 3, 3A and 4 show the arrangement of the contact elements 3, the jumper 5 and an actuating component 6 within the insulating body 1.

Figure 7:
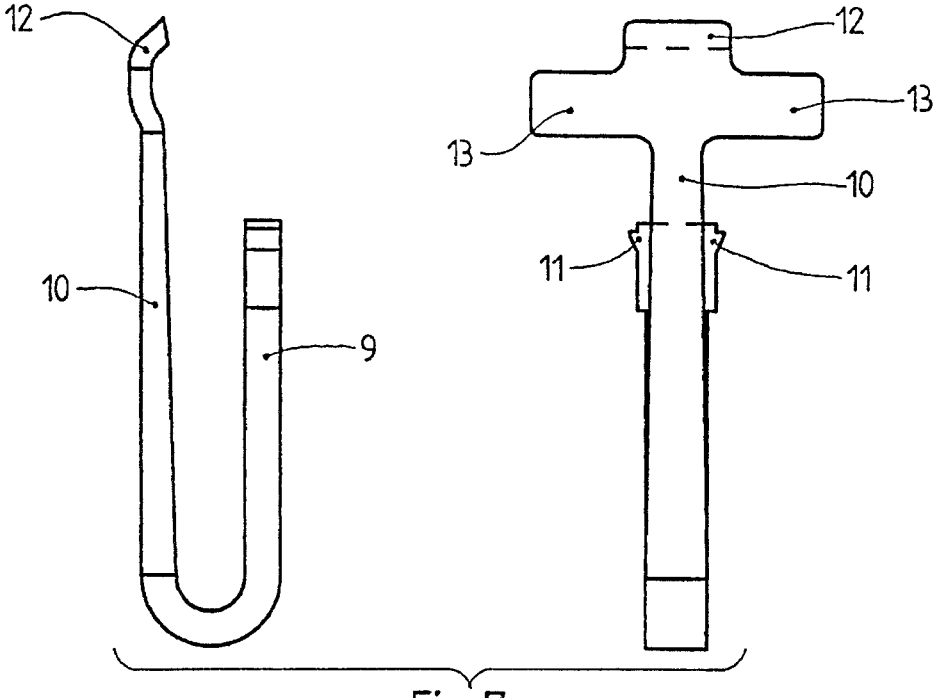
FIG. 7 illustrates the jumper.

As already mentioned, the insulating body is provided with contact chambers 2 into which contact elements 3 are inserted. In between two adjacent contact chambers a recess 7 is molded which is open in the direction of the upper side 8 of the insulating body. The jumper 5 represented in FIG. 7 is inserted into said recess. The jumper made of electrically conductive material is bent so as to be roughly U-shaped and has a fastening leg 9 and a contact leg 10. In this connection the contact leg is spring elastic in relation to the fastening leg. On the fastening leg there are formed latching projections 11 which are provided with a view to anchoring the jumper within the recess 7 and which upon insertion penetrate into the walls thereof. The upper end 12 of the contact leg is T-shaped, two lateral contact arms 13 being formed. After the jumper has been inserted into the recess 7 of the insulating body the contact arms are in such a position that they press resiliently against the contact legs 14 of the contact elements 3' and short circuit the two adjacent contact elements 3'.

In this connection it should also be mentioned that the "normal" contact elements 3 are designed as spring contacts that make contact on either side, with two contact legs in each case, whereas, the contact elements 3' used as switch contacts are designed as contact springs that make contact on one side, with only one contact leg in each case.

Figures 5, 6:
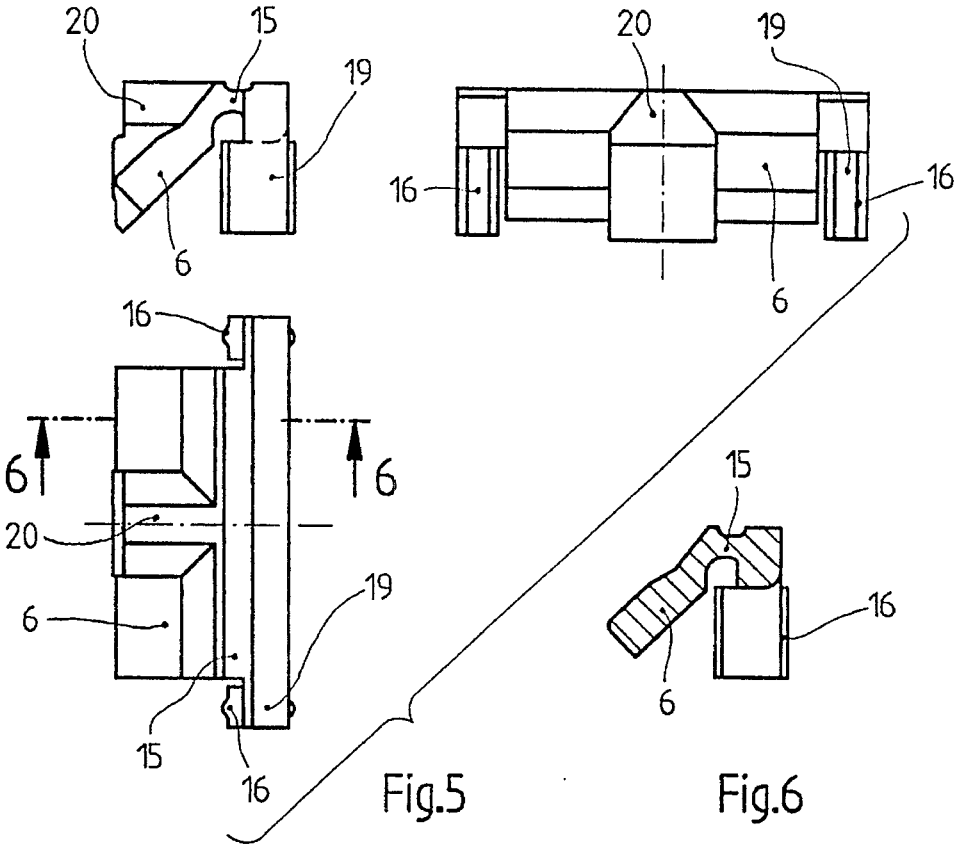
FIG. 5 illustrates the actuating component.
FIG. 6 is a sectional view of the actuating component according to FIG. 5 along line 6—6.

With a view to actuating the switch contacts, i.e., clearing the short circuit when a mating plug is introduced, an actuating component 6 made of plastic material is provided which is illustrated in FIGS. 5 and 6. The actuating component 6 is connected to a fastening component 19 by means of a foil hinge 15. In this connection the fastening component has lateral molded parts 16 which serve to fasten and retain the actuating component in a suitably shaped recess 17 in the upper side 8 of the insulating body. After the fastening component has been inserted into this recess said fastening component protrudes into the two adjacent contact chambers 2, whereby the underside of the actuating component bears against the upper regions of the contact arms 13 of the jumper (FIG. 3). In this connection, the contact arms have corresponding rounded/bent sections with a view to the formation of abutment zones. The upper side 20 of the actuating component is preferably constructed in such a way that after the insertion of this component into the insulating body or the contact chambers the geometry of the entry zone of the contact chambers with switch contacts corresponds to the geometry of the entry zones of the contact chambers with normal contacts.

When a mating plug is plugged in, the blade contacts 18 enter the contact chambers 2 (FIG. 3A). In this connection, the blade contacts assigned to the switch contacts 3' firstly impinge on the upper side of the actuating component 6 and press the latter downward. In the process the underside of the actuating component exerts a force on the contact arms 13 of the jumper 5 and presses the latter to one side in such a way that the connection between the adjacent contact elements 3' is broken. Then the blade contacts come into contact with the contact legs of the contact elements 3'.

When the mating plug is removed, the resilient contact leg 10 of the jumper presses the actuating component back upwards again and the contact arms of the jumper again come into contact with the corresponding contact elements 3'. The above description assumes a jumper made of spring elastic, conductive sheet metal material. Optionally, however, the jumper can also be made of spring elastic plastic material, with the plastic material either being made electrically conductive by suitable additions or having a conductive covering or a metallic galvanization, the latter being provided at least in the region of the contact arms 13. In the case of a jumper made of plastic material, a metallic contact piece can alternatively be fastened to said jumper in the region of the arms by way of a conductive connecting piece.

With regard to the actuating component, it is optionally possible for the latter to be provided with lateral, roller-shaped extensions which are-pressed into a corresponding recess in the upper side of the insulating body so that the actuating component is retained in a manner so as to be capable of pivoting. Alternatively, the actuating component may be integral with the insulating body, the actuating component then being connected to the insulating body via a foil hinge and protruding into the corresponding contact chambers so as to be capable of pivoting.

Whereas the preferred form of the invention has been shown and described herein, it should be realized that there may be many modifications, substitutions and alterations thereto.

The embodiments of the invention in which an exclusive property or privilege is claimed are defined as follows:

1. Switch plug with contact springs arranged in contact chambers of an insulating body, wherein contact blades of a corresponding mating plug are capable of being introduced into the contact chambers and thereby come into contact with the contact springs and in which at least one jumper is provided which short circuits two adjacent contact springs when no mating plug is plugged in and wherein the short circuit is cleared when the blade contacts are introduced into the contact chambers, characterized in that the jumper (5) made of spring elastic, conductive material is inserted into a recess (7) between two contact chambers (2), whereby lateral contact arms (13) of the jumper protrude into the contact chambers and bear resiliently against the contact legs of the contact springs (3'), and in that in the entry zone of the contact chambers (2) an elastic actuating component (6) made of plastic material is provided which upon introduction of a contact blade (19) acts on the jumper (5) in such a way that the contact arms (13) thereof are pushed away from the contact legs (14) of the spring contacts (3') and the short circuit is cleared.

2. Switch plug according to claim 1, characterized in that the jumper (5) is designed to be substantially T-shaped, the upper end (12) comprising the contact arms (13) and the lower end being provided with latching projections (11) which upon insertion of the jumper into the recess (7) penetrate into the walls thereof.

3. Switch plug according to claim 2, characterized in that the lower end of the jumper is bent back in the shape of a U and the latching projections are provided on the part that has been bent back.

4. Switch plug according to claim 1 characterized in that the jumper is made of plastic material and is provided with a conductive coating.

5. Switch plug according to claim 1 characterized in that the jumper is made of plastic material and the region of the contact arms is provided with a conductive coating.

6. Switch plug according to claim 1 characterized in that the jumper (5) is made of plastic material and in the region of the contact arms a conductive contact piece is provided which covers said arms.

7. Switch plug according to claim 1 characterized in that the elastic actuating component (6) is provided on a base which takes the form of a fastening component (19) and the fastening component is pressed into a recess (17) in the upper side (8) of the insulating body (1) of the switch plug, whereby the actuating component (6) then protrudes into the contact chambers (2) provided with the jumper (5).

8. Switch plug according to claim 7, characterized in that the connection between the actuating component (5) and the base (19) takes the form of a foil hinge (15).

9. Switch plug according to claim 7 characterized in that the fastening component (19) is provided with peg-shaped molded parts (16) which are inserted into a recess (17) in the upper side (8) of the insulating body (1) so that the actuating component (6) is held so as to be capable of rotating/pivoting and thereby protrudes into the contact chambers (2) provided with the jumper (5).

10. Switch plug according to claim 1 characterized in that the actuating component (6) is integrally molded onto the insulating body in the region of the respective contact chambers (2) via a foil hinge-type connecting element.

11. Switch plug according to claim 1 characterized in that the insulating body takes the form of a one-piece insulating body.

12. Switch plug according to claim 1 characterized in that the contact springs (3') provided in the contact chambers (2) into which the contact arms (13) of the jumper (5) protrude are designed as contact springs which make contact on one side and the remaining contact springs of the switch plug are designed as contact springs (3) which make contact on two sides.

13. Switch plug according to claim 1 characterized in that the contact geometry or insulating body geometry is designed to conform to DIN plug connector standards.

* * * * *